US006595154B2

(12) United States Patent
Boatman

(10) Patent No.: US 6,595,154 B2
(45) Date of Patent: Jul. 22, 2003

(54) CONNECTION ARRANGEMENT FOR SPIDER BUOY TO CONNECTOR

(75) Inventor: L. Terry Boatman, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/083,769

(22) Filed: Feb. 27, 2002

(65) Prior Publication Data

US 2002/0117098 A1 Aug. 29, 2002

Related U.S. Application Data

(60) Provisional application No. 60/271,975, filed on Feb. 27, 2001.

(51) Int. Cl.[7] ..... B63B 21/00; B63B 22/02

(52) U.S. Cl. ..... 114/230.12; 441/3

(58) Field of Search ..... 114/230.12, 293; 441/3, 4, 5

(56) References Cited

U.S. PATENT DOCUMENTS 4,086,865 A * 5/1978 Statham ..... 114/230.13
4,490,121 A 12/1984 Coppens et al.
4,533,332 A 8/1985 Coppens et al.
4,604,961 A 8/1986 Ortloff et al.
4,892,495 A 1/1990 Svensen
5,065,689 A 11/1991 Krogstad
5,339,760 A * 8/1994 Korsgaard ..... 441/3
5,380,229 A * 1/1995 Korsgaard ..... 441/3
5,529,521 A * 6/1996 Breivik et al. ..... 441/5
5,628,657 A * 5/1997 Breivik et al. ..... 441/5
5,951,061 A * 9/1999 Arlt et al. ..... 285/94

* cited by examiner

*Primary Examiner*—S. Joseph Morano
*Assistant Examiner*—Andrew Wright
(74) *Attorney, Agent, or Firm*—Gary L. Bush; Andrews & Kurth, L.L.P.

(57) ABSTRACT

Connection arrangements for a male probe and female receiver for selective connection of a spider buoy with a turret for mooring a vessel in offshore waters. A resilient member is provided in the male probe to absorb forces on the probe as it is being pulled into the receiver. A seal is provided between surfaces of the probe and the receiver to seal seawater from the interior of the turret. Contact rings at the bottom opening of the receiver and at the base of the male probe are machined of hardened strengthened steel and test assembled together prior to bolting of the rings to the receiver and the spider buoy respectively.

27 Claims, 3 Drawing Sheets

FIG. 3
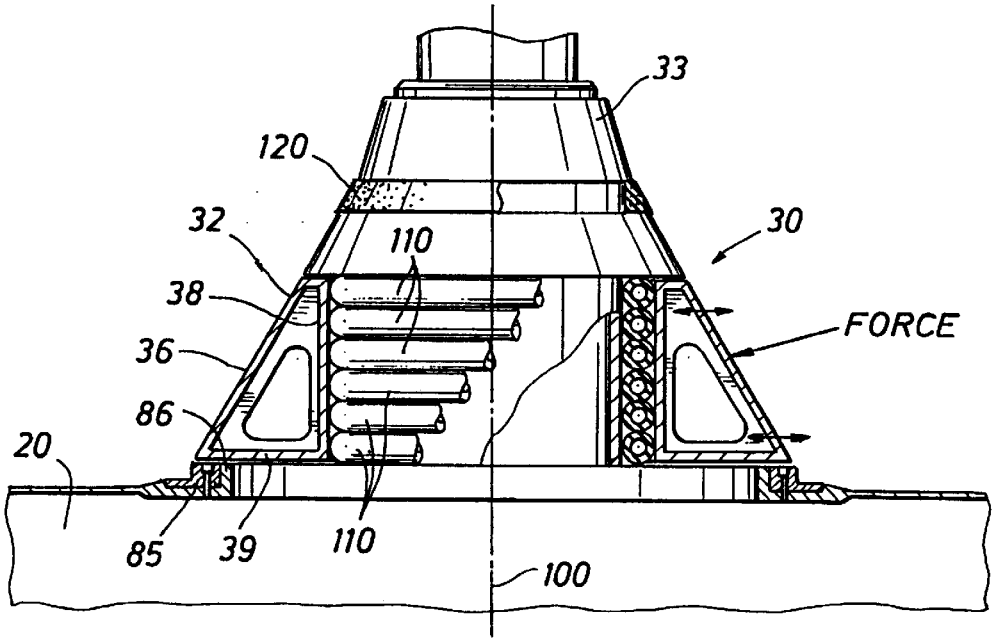
FIG. 4
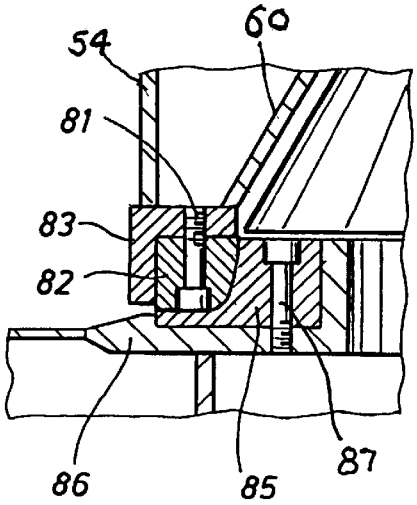
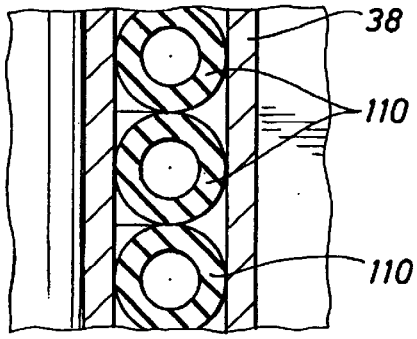
FIG. 5

CONNECTION ARRANGEMENT FOR SPIDER BUOY TO CONNECTOR

CROSS-REFERENCE TO RELATED APPLICATION

This application claims priority from Provisional Application No. 60/271,975 filed on Feb. 27, 2001.

BACKGROUND OF THE INVENTION

1. Field of the Invention

This invention concerns disconnectable turret mooring systems for Floating Production, Storage and Offloading (FPSO) vessels and the like.

2. Description of the Prior Art

The prior art includes disconnectable mooring systems such as that described in U.S. Pat. No. 5,356,321 which is assigned to the assignee of this application. The mooring system includes a turret which is rotatably supported by a FPSO. A buoyant mooring member, called a "spider buoy," is structurally connected to the bottom of the turret. Rotatable support is provided by an axial/radial bearing between the top of the turret and a moonpool sleeve in the vessel and a radial bearing at the bottom of the turret and the moonpool sleeve. The spider buoy carries risers from the sea floor to connect with pipes which run through the interior of the turret. Anchor legs or chains are connected between the spider buoy and the sea floor.

A selectively operable structural connector secured to the bottom of the turret connects to a hub extending upwardly from the top of the buoy. The above-mentioned U.S. patent illustrates a collet connector manufactured by Cooper Cameron of Houston, Tex. which acts cooperatively with a preload tensioning arrangement to provide a structural connection between the buoy and the turret. TORUS structural connectors manufactured by FMC Technologies of Houston, Texas have also been used in the past in the arrangement. The term TORUS is a trademark for such connector of FMC.

Other arrangements are known for selectively connecting a buoyant mooring member to a turret of an offshore storage vessel. U.S. Pat. No. 4,604,961 shows a turret which is rotatably supported on a vessel by bearings with the turret having a frusto-conically-shaped opening and with the buoyant mooring element having a frusto-conically-shaped skirt which fits cooperatively within the opening. A latching mechanism locks the turret to the buoyant member when the buoyant member is pulled fully into the opening.

U.S. Pat. No. 4,892,495 also shows a buoyant mooring member of a conical shape which is pulled into an opening of a turret which has a conical shape and is latched thereto when it is fully pulled therein.

3. Identification of Objects of the Invention

A primary object of the invention is to provide a less costly coupling arrangement between the spider buoy and the turret of a disconnectable mooring system than previously known.

Another object of the invention is to provide a spider buoy/turret coupling arrangement with a resilient member which can resiliently absorb forces on a connection member while the buoyant member is being pulled into connection with the turret.

Another object of the invention is to provide a spider buoy/turret coupling arrangement which includes a sealing mechanism between the spider buoy and the turret so that seawater is prevented from entering the interior of the turret after the spider buoy is pulled into connection with the turret.

Another object of the invention is to provide contact rings between the bottom of the turret and the top of the spider buoy which are strong enough to support vertical and radial loads between the turret and spider buoy when the spider buoy is connected to the turret and can be machined with precision to provide close tolerances at a machining location away from the turret and/or the buoyant member such that the contact rings can be actually fit together before they are individually installed at the bottom of the turret and the top of the spider buoy.

SUMMARY OF THE INVENTION

The objects described above as well as other advantages and features of the invention are provided in a mooring arrangement having a turret rotatably supported on the vessel with a receiver structure at the bottom of the turret which has a female frusto-conically-shaped opening. A buoyant mooring member or buoy includes a male frusto-conically-shaped structure secured to its top end. The male structure or probe includes a hub secured at its top which is part of a hydraulic structural connector pair. The hydraulic connector is mounted at the top of the receiver structure and above the female opening at the bottom of the turret. When the male structure is fully pulled into the female opening, the hub is in registration with the hydraulic connector and can be latched thereto.

According to one feature of the invention, the male structure includes an interior resilient member which absorbs shock forces caused by pulling the male member into the female opening of the turret. Such structure, called a shock absorber cone, includes a stack of donut shaped resilient members within the male structure.

According to another feature of the invention, a sealing arrangement is provided between the male frusto-conically-shaped structure and the receiver structure at the bottom of the turret. A primary seal is established by an elastomeric ring on the outer frusto-conical structure of the buoyant element which engages an annular surface on the female frusto-conically-shaped structure of the receiver. Secondary sealing is provided by ports through a reaction ring of the receiver structure which lead to an interface between the exterior surface of the male probe and the interior surface of the female turret receiver. Sealing material can be forced through such ports if the primary seal were to leak.

According to another feature of the invention, the base of the conically shaped probe includes a ring of strengthened hardened steel with upwardly and outwardly facing surfaces provided thereon. A complimentary ring of strengthened hardened steel is disposed on the turret at the bottom end of the receiver and has downwardly and inwardly facing surfaces. The complimentary surfaces are machined in the hardened steel prior to fastening to the top of the buoyant member and the bottom of the receiver respectively and test assembled together prior to fastening to the buoy and to the turret. Fastening is by means other than welding such as bolts so as not to damage the hardened material of the rings by the heat of welding.

BRIEF DESCRIPTION OF THE DRAWINGS

FIG. 3 illustrates a preferred embodiment of a shock-absorbing element placed within a lower portion of the probe and an elastomeric seal provided on an external surface of the probe;

FIG. 4 is an enlarged sectional view of the interfit and placement of the lower reaction at the bottom of the turret and a complimentary ring at the top of the buoy; and FIG. 5 is an enlarged cross-section showing the construction of a preferred embodiment of the elastomeric element in the probe.

DESCRIPTION OF THE PREFERRED EMBODIMENT OF THE INVENTION

Figure 1:
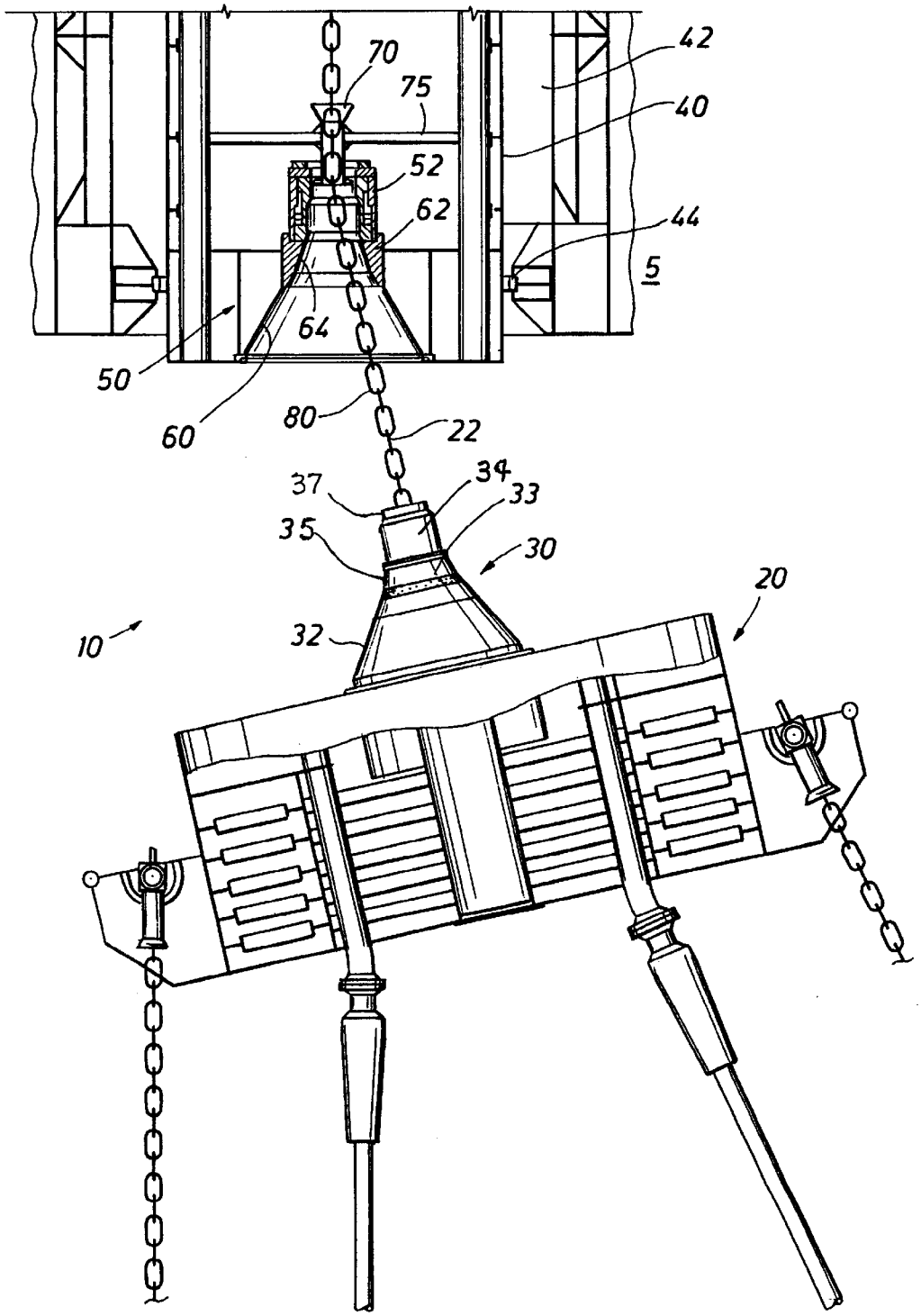
FIG. 1 shows a buoyant mooring element with a frusto-conical male structural element or probe attached to the top thereof being pulled into a frusto-conical opening or receiver of a lower turret structure.

The invention, as defined by the claims hereto, is embodied in a detachable mooring system 10 illustrated in FIG. 1 which shows a detachable mooring element or buoy 20 being pulled toward vessel 5 by chains for selective connection thereto. The buoy 20 includes a male structure or probe 30 having a frusto-conical shaped exterior surface 32 with a generally cylindrical hub 36 mounted at its top end. The buoy 20 as illustrated includes anchor chains, riser pipes, buoyancy chambers and a chain locker, all of which, while essential to a functioning detachable buoy which can be selectively coupled to a turret of a vessel, need no detailed description in connection with the invention. Likewise, one or more alignment pins (not illustrated) are provided between the bottom of the turret and the top of the buoy so that proper angular orientation is achieved when the buoy and turret are structurally connected together. Such orientation is needed so that the risers from the buoy line up for coupling with flow pipes of the turret.

The turret 40 of the vessel 5 is rotatably supported by bearings in a well or moonpool 42 of the vessel. Upper axial/radial bearings (not shown) support the turret on the vessel 5 and allow the vessel 5 to weathervane about the turret 40 and buoy 20 when the buoy is structurally connected to the turret. A lower radial bearing assembly 44 provides radial rotatable support between the lower portion of turret 40 and the wall of the well 42 of the vessel 5.

The bottom of the turret 40 includes a receiver structure 50 with a hydraulically powered structural connector 52 mounted at the top of a downwardly facing conical structure 60. As indicated above, structural connectors are commercially available from Cooper Cameron Corp. and FMC Technologies, Inc., both of Houston, Tex. The receiver structure 50 (best seen in FIG. 2) includes vertical members 54, radial supports 56, 58, 61, upper reaction ring 62, connector support 63 mounted to the top of reactor ring 62, and frusto-conical member 60 disposed between the lower end of connector support 62 and the lower end of vertical supports or cylinder 54.

The internal shape 64 of upper reaction ring 62 is that of a downwardly facing frusto cone which is complimentary to that of the external shape 35 of a secondary frusto-conically shaped member 33 of male structure 30. An upper cylindrical member or hub 34 extends upwardly from said secondary conical member 33 and is arranged and dimensioned to fit within the structural connector 52. Teeth 37 at the top of hub 34 are smaller in diameter than the body of hub 34 thereby preventing contact of the teeth 37 against the interior of receiver 50 during pull in.

A chain guide 70, mounted on horizontal support 75, guides pull in chain 80 which is connected to the buoy 20 and is pulled in from a winch (not shown) at an upper deck of the vessel 5 or the turret 40.

A lower reaction ring 82 is fastened to the vertical supports 54 (or cylinder) and the frusto-conical member 60 via bracket ring 83. See the enlarged sectional view of FIG. 4. Bolts 81 fasten ring 82 to the bracket ring 83. Bracket ring 83 may be welded to members 60 and 54, but it is preferred to fabricate lower reaction ring 82 from strengthened hardened steel and machine a slightly conical inwardly facing anchor surface and a slightly conical downwardly facing anchor surface in ring 82 before fastening to the bracket ring 83. Bolting of the lower reaction ring 82 to the bracket ring 83 is preferred because of its fabrication from hardened steel, the hardened and strengthened properties of which could be damaged through the heat of welding.

A complimentary ring 85 is provided on a mounting ring 86 which is fastened to the top of the buoy 20. The ring 85, also made of hardened steel includes machined slightly conical outwardly and slightly conical upwardly facing surfaces which match with close tolerance the opposite surfaces of lower reaction ring 82. When rings 82 and 85 are pulled tightly together, the tapered slightly conical surfaces cause a zero clearance fit between the two rings so that no radial sliding motion is possible. Machining is preferably performed before the complimentary ring 85 is fastened to mounting ring 86 by means of bolts 87, or other non-welding fastening means. Close tolerances between the radial and axial surfaces between the lower reaction ring 83 and the complimentary ring 85 inhibit rocking and sliding action of the bottom connection point between the bottom of the turret and the base of the male structure or probe 30. The rings 85 and 83 can be fit together for size before they are bolted to bracket ring 83 and mounting ring 86.

Figure 2:
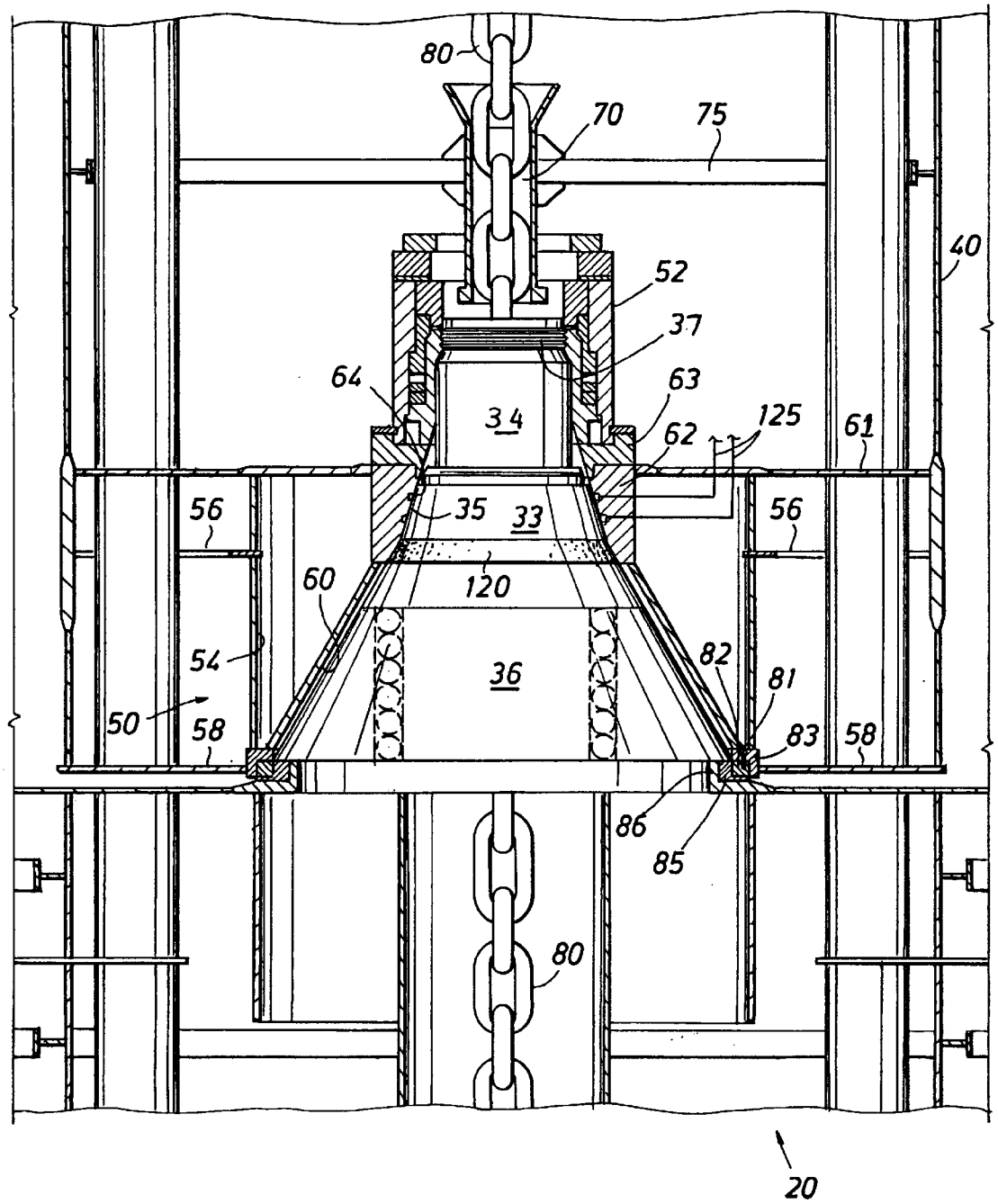
FIG. 2 is an illustration of the probe docked within the receiver of the lower turret structure with a top hub of the probe latched by a hydraulic powered structural connector.

FIG. 3 shows a cross section through the lower frusto-conically-shaped portion 32 of male structure 30 mounted on the top of buoy 20. The structure of portion 32 includes a ring of structural material having a half cross section of a right triangle shape. The hypotenuse 36 of the triangle when rotated about centerline 100 defines the frusto-conical shape of lower section 32 of the male probe 30. The vertical side 38 of the triangle defines an internal cylindrical hollow space when the triangle is rotated about centerline 100. The horizontal side 39 of the triangle defines a bottom support plate around the structure of portion 32. For clarity of illustration, the preferred arrangement for coupling lower section 32 to the top of the buoy 20 is not shown, but it should be understood to be as illustrated in FIGS. 2 and 4 where ring 83 is coupled to ring 85. A stack of elastomeric rings 110 is placed within the cylindrical space. Each ring has the shape of a donut as illustrated in FIG. 3 and FIG. 5. The rings are commercially available in lengths of dock bumper material. Each ring 110 of the stack is produced by forming a length of dock bumper material into a circular shape and joining the ends. The elastomeric rings cause the probe 30 to be capable of absorbing a shock force, illustrated by the arrow labeled FORCE, against the side of the probe when the buoy is being pulled in for connection of the buoy 20 to the vessel 5 with the probe 30 entering the receiver structure 50.

FIG. 3 also illustrates an elastomeric seal 120 which is placed in a groove at the lower end of secondary conical member 33. FIG. 2 illustrates that seal 120 about the exterior surface of male probe 30 engages a complimentary inwardly facing surface of upper reaction ring 62 when the male structure 30 is fully pulled into receiver structure 50. Seal 120 serves to prevent water from entering the inside of turret 40 once the buoy 20 is structurally connected to the turret. Water is pumped from the inside of the turret so that workers can inspect the connector 52.

Secondary sealing is provided by lines 125 (see FIG. 2) which lead to ports at the interface of the male probe section 33 with the reaction ring 62. Sealing material such as grease or other suitable flowable compounds can be applied via lines 125 from pressurized sources (not shown) for sealing leak paths which could possibly develop past seal 120.

Alternative embodiments of the invention may be made to the invention. In the embodiments illustrated above the buoy includes a male mating structure and the turret includes a corresponding female mating structure. However, such mating structure may be reversed with a female mating structure located on the buoy and with a male mating structure being located at the bottom of the turret.

What is claimed is:

1. An improved detachable mooring system for a vessel, said system including a vertically aligned turret which is arranged and designed to be rotatably secured with said vessel such that said vessel and turret can rotate with respect to each other with the bottom end of said turret facing downwardly toward the sea and the system including a buoyant mooring element and a plurality of mooring lines extending between and connected to said mooring element and the sea floor and including a connector assembly mounted at the top of said mooring element and a hydraulically powered selectively operable connector mounted at the bottom of said turret which is arranged and designed for selective connection to said connector assembly, wherein the improvement comprises, said buoyant mooring element having a male structure with an outwardly facing frusto-conically shaped portion and with a hub mounted on a top end of said male structure, said male structure including a resilient member disposed therein, said bottom end of said turret having a receiver structure with a frusto-conically shaped female opening with said hydraulically powered connector supported from said turret at a top end of said receiver, said male structure and said female opening being arranged and designed so that when said male structure is pulled up into said receiver, said hub enters within said powered connector for selective structural connection of said connector to said hub, whereby a force acting on the exterior of said male structure while said male structure is being pulled into said female opening is at least partially absorbed by compression of said resilient member.

2. The mooring system of claim 1 wherein said buoyant mooring element has an upwardly facing annular shoulder disposed about a base of said male structure, said bottom end of said turret has a downwardly facing annular shoulder disposed about said female opening, and said upwardly facing annular shoulder and said downwardly facing annular shoulder are in contact when said powered connector structurally connects to said hub.

3. The mooring system of claim 2 wherein, said male structure includes a male structure ring disposed at a bottom end of said upwardly facing frusto-conically shaped portion, said male structure ring including an upwardly facing surface and an outwardly facing surface, said bottom end of said turret having a female opening ring disposed about said female opening, said female opening ring including a downwardly facing surface and an inwardly facing surface, said male structure ring and said female opening ring being arranged and designed for registration of said upwardly facing surface with said downwardly facing surface and said outwardly facing surface with said inwardly facing surface when said male structure is pulled up into said receiver and said hub is connected by said connector.

4. The mooring system of claim 3 wherein, said male structure ring is fastened to said top of said buoyant mooring element by non-welding means and said female opening ring is fastened to said bottom end of said turret by non-welding means.

5. The mooring system of claim 3 wherein, said male structure ring and said female opening ring are fabricated from hardened steel, and said upwardly facing surface and said outwardly facing surface of said male structure ring and said downwardly facing surface and said inwardly facing surface of said female opening ring being machined surfaces, wherein said machine surfaces are applied to said male structure ring and said female opening ring prior to fastening of said male structure ring to said mooring element and fastening of said female opening ring to said bottom end of said turret.

6. The mooring system of claim 1 wherein, said resilient member includes a stack of resilient ring shaped elements.

7. The mooring system of claim 6 wherein, said stack of resilient elements is placed in a cylindrical space defined by a hollow ring having an outer frusto-conical shape.

8. The mooring system of claim 1 wherein, said male structure of said buoyant mooring element has an outwardly facing elastomeric seal disposed thereon, and said receiver has an inwardly facing surface which is arranged and designed to sealingly contact said elastomeric seal of said male structure when said male structure is pulled up into said receiver.

9. The mooring system of claim 1 wherein, said outwardly facing frusto-conically shaped portion of said male structure includes a lower upwardly facing frusto-conically shaped portion and an upper upwardly facing frusto-conically shaped portion, said frusto-conically shaped female opening of said bottom end of said turret includes a lower downwardly facing frusto-conically shaped portion and an upper downwardly facing frusto-conically shaped portion, wherein said male structure and said receiver are cooperatively arranged and designed so that when said male structure is pulled up into said female opening, said lower frusto-conically shaped portion of said male structure is in registration with said lower frusto-conically shaped portion of said receiver and said upper frusto-conically shaped portion of said male structure is in registration with said upper frusto-conically shaped portion of said receiver.

10. The mooring system of claim 1 wherein, said hub of said male member having a base with a connection teeth section disposed at the top of said base, wherein the outer diameter of said teeth section is less than the outer diameter of said base.

11. The mooring system of claim 1 wherein, an elastomeric seal is disposed in sealing contact between said male structure and said receiver at a location below said cylindrical hub and said bottom end of said turret.

12. An improved detachable mooring system for a vessel, said system including a vertically aligned turret which is arranged and designed to be rotatably secured with said vessel such that said vessel and turret can rotate with respect to each other with the bottom end of said turret facing downwardly toward the sea and the system including a buoyant mooring element and a plurality of mooring lines extending between and connected to said mooring element and the sea floor and including a connector assembly mounted at the top of said mooring element and a hydraulically powered selectively operable connector mounted at the bottom of said turret which is arranged and designed for selective connection to said connector assembly, wherein the improvement comprises, said buoyant mooring element having a male structure with an outwardly frusto-conically-shaped portion and with a hub mounted on a top end of said male structure, said bottom end of said turret having a receiver with a frusto-conical shaped female opening with said hydraulically powered connector mounted to said turret at a top end of said opening, said male structure and said receiver being arranged and designed so that when said male structure is pulled up into said female opening, said cylindrical hub enters within said powered connector for selective latching of said connector to said hub, an elastomeric seal is disposed in sealing contact between said male structure and said female opening at a location below said hub and above said bottom end of said turret when said hub is latched in said connector, and said male structure has a resilient member disposed therein, whereby a force acting on the exterior of said male structure while said male structure is being pulled into said female opening is at least partially absorbed by compression of said resilient member.

13. The mooring system of claim 12 wherein, said resilient member includes a stack of resilient ring shaped elements.

14. The mooring system of claim 13 wherein, said stack of resilient elements is placed in a cylindrical space defined by a hollow ring having an outer frusto-conical shape.

15. The mooring system of claim 12 wherein, said buoyant mooring element includes an upwardly facing annular shoulder disposed about a base of said male structure, said bottom end of said turret has a downwardly facing annular shoulder disposed about said female opening, and said upwardly facing annular shoulder and said downwardly facing annular shoulder are in contact when said powered connector latches to said hub.

16. The mooring system of claim 12 wherein, said male structure includes a male structure ring disposed at a bottom end of said upwardly facing frusto-conically shaped portion, said male structure ring including an upwardly facing surface and an outwardly facing surface, said bottom end of said turret having a female opening ring disposed about said female opening, said female opening ring including a downwardly facing surface and an inwardly facing surface, said male structure ring and said female opening ring being arranged and designed for registration of said upwardly facing surface with said downwardly facing surface and said outwardly facing surface with said inwardly facing surface when said male structure is pulled up into said receiver and said hub is connected by said connector.

17. The mooring system of claim 16 wherein, said male structure ring is fastened to said top of said buoyant mooring element by non-welding means and said female opening ring is fastened to said bottom end of said turret by non-welding means.

18. The mooring system of claim 16 wherein, said male structure ring and said female opening ring are fabricated from hardened steel, and said upwardly facing surface and said outwardly facing surface of said male structure ring and said downwardly facing surface and said inwardly facing surface of said female opening ring are machined surfaces, wherein said machine surfaces are applied to said male structure ring and said female opening ring prior to fastening of said male structure ring to said mooring element and fastening of said female opening ring to said bottom end of said turret.

19. An improved detachable mooring system for a vessel, said system including a vertically aligned turret which is arranged and designed to be rotatably secured with said vessel such that said vessel and turret can rotate with respect to each other with the bottom end of said turret facing downwardly toward the sea and the system including a buoyant mooring element and a plurality of mooring lines extending between and connected to said mooring element and the sea floor and including a connector assembly mounted at the top of said mooring element and a hydraulically powered selectively operable connector mounted at the bottom of said turret which is arranged and designed for selective connection to said connector assembly, wherein the improvement comprises, said buoyant mooring element having a male structure with an outwardly frusto-conically-shaped portion and with a hub mounted on a top end of said male structure, said bottom end of said turret having a receiver with a frusto-conical shaped female opening with said hydraulically powered connector supported from said turret at a top end of said opening, said male structure and said female opening being arranged and designed so that when said male structure is pulled up into said female opening, said hub enters within said powered connector for selective structural connection of said connector to said hub, and wherein said male structure includes a male structure ring disposed at a bottom end of said upwardly facing frusto-conically shaped portion, said male structure ring including an upwardly facing surface and an outwardly facing surface, said bottom end of said turret having a female opening ring disposed about said female opening, said female opening ring including a downwardly facing surface and an inwardly facing surface, said male structure ring and said female opening ring being arranged and designed for registration of said upwardly facing surface with said downwardly facing surface and said outwardly facing surface with said inwardly facing surface when said male structure is pulled up into said female opening and said cylindrical hub is connected by said connector.

20. The mooring system of claim 19 wherein, said male structure ring is fastened to said top of said buoyant mooring element by non-welding means and said female opening ring is fastened to said bottom end of said turret by non-welding means.

21. The mooring system of claim 19 wherein, said male structure ring and said female opening ring are fabricated from hardened steel, and said upwardly facing surface and said outwardly facing surface of said male structure ring and said downwardly facing surface and said inwardly facing surface of said female opening ring are machined surfaces, where said machine surfaces are applied to said male structure ring and said female opening ring prior to fastening of said male structure ring to mooring element and fastening of said female opening ring to said bottom end of said turret.

22. The mooring system of claim 19 wherein, an elastomeric seal is disposed in sealing contact between said male structure and said receiver at a location below said cylindrical hub and said bottom end of said turret, when said hub is structurally connected in said connector.

23. The mooring system of claim 19 wherein, said male structure has a resilient member disposed therein, whereby a force acting on the exterior of said male structure while said male structure is being pulled into said receiver is at least partially absorbed by compression of said resilient member.

24. The mooring system of claim 23 wherein, said resilient member includes a stack of resilient ring shaped elements.

25. The mooring system of claim 24 wherein, said stack of resilient elements is placed in a cylindrical space defined by a hollow ring having an outer frusto-conical shape.

26. An improved detachable mooring system for a vessel said system including a vertically aligned turret which is arranged and designed to be rotatably secured with said vessel such that said vessel and turret can rotate with respect to each other with the bottom end of said turret facing downwardly toward the sea and the system including a buoyant mooring element and a plurality of mooring lines extending between and connected to said mooring element and the sea floor and including a connector assembly mounted at the top of said mooring element and a hydraulically powered selectively operable connector mounted at the bottom of said turret which is arranged and designed for selective connection to said connector assembly, wherein the improvement comprises, said buoyant mooring element having a first mating structure with a first frusto-conically shaped portion and with a hub mounted on said first mating structure, said bottom end of said turret having a second mating structure with a second frusto-conically shaped portion which is arranged and designed to register with said first frusto-conically-shaped portion, with said hydraulically powered connector supported from said second mating structure, said first mating structure and said second mating structure being arranged and designed so that when said first mating structure is pulled up into mating relationship with said second mating structure, said hub enters within said powered connector of said second mating structure for selective structural connection of said connector to said hub, wherein a resilient member is disposed within at least one of said first mating structure or said second mating structure, whereby a force acting on the exterior of said at least one of said first mating structure or said second mating structure while said second mating structure is being pulled into mating relationship with said first mating structure is at least partially absorbed by compression of said resilient member.

27. An improved detachable mooring system for a vessel, said system including a vertically aligned turret which is arranged and designed to be rotatably secured with said vessel such that said vessel and turret can rotate with respect to each other with the bottom end of said turret facing downwardly toward the sea and the system including a buoyant mooring element and a plurality of mooring lines extending between and connected to said mooring element and the sea floor and including a connector assembly mounted at the top of said mooring element and a hydraulically powered selectively operable connector mounted at the bottom of said turret which is arranged and designed for selective connection to said connector assembly, wherein the improvement comprises, said buoyant mooring element having a first mating structure with a first frusto-conically shaped portion and with a hub mounted on said first mating structure, said bottom end of said turret having a second mating structure with a second frusto-conically shaped portion which is arranged and designed to register with said first frusto-conically-shaped portion, with said hydraulically powered connector supported from said second mating structure, said first mating structure and said second mating structure being arranged and designed so that when said first mating structure is pulled up into mating relationship with said second mating structure, said hub enters within said powered connector of said second mating structure for selective structural connection of said connector to said hub, and wherein said first mating structure includes a first structure ring disposed at a bottom end of said upwardly first frusto-conically shaped portion, said first structure ring including an upwardly facing surface and an outwardly facing surface, said bottom end of said turret having a second structure ring disposed about said second mating structure, said second structure ring including a downwardly facing surface and an inwardly facing surface, said first structure ring and said second structure ring being arranged and designed for registration of said upwardly facing surface with said downwardly facing surface and said outwardly facing surface with said inwardly facing surface when said first mating structure is pulled up into mating relationship with said second mating structure and said cylindrical hub is connected by said connector.

* * * * *